US010244877B2

(12) United States Patent
Bradshaw

(10) Patent No.: US 10,244,877 B2
(45) Date of Patent: Apr. 2, 2019

(54) FLEXIBLE PILLOW DEVICE

(71) Applicant: Rakeem Bradshaw, Louisville, KY (US)

(72) Inventor: Rakeem Bradshaw, Louisville, KY (US)

( * ) Notice: Subject to any disclaimer, the term of this patent is extended or adjusted under 35 U.S.C. 154(b) by 360 days.

(21) Appl. No.: 14/850,099

(22) Filed: Sep. 10, 2015

(65) Prior Publication Data

US 2016/0081500 A1 Mar. 24, 2016

Related U.S. Application Data

(60) Provisional application No. 62/053,889, filed on Sep. 23, 2014.

(51) Int. Cl.

| | |
|---|---|
| ***A47G 9/10*** | (2006.01) |
| ***A47G 9/00*** | (2006.01) |
| ***A47C 27/22*** | (2006.01) |
| ***A47C 27/08*** | (2006.01) |

(52) U.S. Cl.

CPC ..... *A47G 9/10* (2013.01); *A47G 9/1063* (2013.01); *A47G 2009/1018* (2013.01)

(58) Field of Classification Search

CPC ..... A47G 9/10; A47G 9/1063; A47G 2009/1018; A47G 9/00; A47C 22/27; A47C 22/08

See application file for complete search history.

(56) References Cited

U.S. PATENT DOCUMENTS

| | | | | | |
|---|---|---|---|---|---|
| 681,573 | A * | 8/1901 | Nichols | A47C 27/001 | 5/722 |
| 2,765,480 | A * | 10/1956 | Mueller | A47C 7/021 | 5/630 |
| 2,877,472 | A | 3/1959 | Wagner | | |
| 3,299,451 | A * | 1/1967 | Trogdon | A47G 9/10 | 5/636 |
| 3,327,330 | A * | 6/1967 | McCullough | A47G 9/10 | 5/636 |
| 3,849,810 | A * | 11/1974 | Degen | A47G 9/109 | 5/640 |
| 3,968,529 | A * | 7/1976 | Levin | A47G 9/10 | 5/640 |

(Continued)

*Primary Examiner* — Robert G Santos
*Assistant Examiner* — Rahib T Zaman
(74) *Attorney, Agent, or Firm* — Global Intellectual Property Agency, LLC; Daniel Boudwin

(57) ABSTRACT

A flexible pillow device is provided that is formed of a plurality of pillow members connected in an aligned arrangement. The pillow members are connected along their sides and are pivotable relative to one another to form either a flat or arch configuration. The device is useful for serving as a one of a flat pillow, one that can conform to an underlying shape, or one that can form a free-standing arch shape with an open interior. In one embodiment, the pillow members include a first side portion that is aligned with an adjacent pillow member, and with a second side portion that is faceted inward to allow adjacent pillows to form against one another when in an arch configuration. Another embodiment contemplates rounded pillow members. When in an arch configuration, the open interior accommodates a user's arm for sleeping on one's side or when sleeping with a partner.

9 Claims, 5 Drawing Sheets

(56) References Cited

U.S. PATENT DOCUMENTS

| | | | | |
|---|---|---|---|---|
| 4,275,473 | A * | 6/1981 | Poirier | A47C 1/146 441/128 |
| 5,572,757 | A * | 11/1996 | O'Sullivan | A47C 7/46 297/284.5 |
| 5,579,551 | A | 12/1996 | Tommaney | |
| 5,604,944 | A | 2/1997 | Meade | |
| 6,041,458 | A | 3/2000 | Vickers | |
| 7,216,387 | B2 | 5/2007 | Laxton | |
| 7,587,773 | B2 * | 9/2009 | Littlehorn | A47C 16/00 5/632 |
| 7,962,984 | B2 | 6/2011 | Popp | |
| 7,975,336 | B1 * | 7/2011 | Perry | A47C 20/027 5/636 |
| 9,089,230 | B2 * | 7/2015 | Cho | A61F 5/01 |
| 2006/0123547 | A1 * | 6/2006 | Ferber | A47G 9/0253 5/636 |
| 2011/0225735 | A1 * | 9/2011 | Heroux | A47G 9/10 5/640 |
| 2014/0082845 | A1 * | 3/2014 | Pastrmac | A47C 20/027 5/636 |
| 2018/0049568 | A1 * | 2/2018 | Cruz | A47G 9/1027 |

* cited by examiner

FLEXIBLE PILLOW DEVICE

CROSS REFERENCE TO RELATED APPLICATION

This application claims the benefit of U.S. Provisional Application No. 62/053,889 filed on Sep. 23, 2014. The above identified patent application is herein incorporated by reference in its entirety to provide continuity of disclosure.

BACKGROUND OF THE INVENTION

Field of the Invention

The present invention relates to pillow and cushion devices. More specifically, the present invention relates to flexible or adjustable pillow devices that can form a flat shape or a curved shape to accommodate a user's head and the limb of a user thereunder.

Pillows are common devices that are used for cushioning while resting or sleeping. These devices are commonplace and provide a cushioned area to rest one's head or body while lying down, sitting, or otherwise lying on a furniture item. While sleeping, many enjoy specific sleeping positions that suit their posture, their habits, or their preferences. These positions include sleeping on one's back, or sleeping on one's side, or even sleeping on one's stomach. Each of these positions raises ergonomic concerns with respect to the user's neck and positioning of the user's limbs.

Along with sleeping preferences of an individual user, ergonomics are implicated when sleeping with a partner. If two individuals share a bed in close proximity, one user may rest on the other. Therefore, a need arises for a flexible or arrangeable pillow that allows a user to correctly support his or her head and limbs while sleeping alone or in tandem with a partner. Additionally, a need exists for a pillow that enables a user to place his or her arms beneath the pillow, where the user's head will not place pressure on the arms below the pillow. Finally, a need exists for a pillow that can be placed in a flat state or an arch shape to accommodate a single user's preferred sleeping position, whereby the shape of the pillow can be arranged to support the user's head and neck as desired and based on the sleep position.

The present invention comprises a flexible pillow device comprising a plurality of pillow members disposed in an aligned stated and connected along their sides. The pillow members are pivotable relative to one another to form a flat configuration or an arch configurator when the pillow members are pivoted relative to one another. A connection between the pillow members and a recess between adjacent pillow members allows each adjacent pillow member to pivot relative to one another to transition from a flat configuration to an arch configuration. When in the form of an arch, the pillow can support a user's head while a user's limb is positioned through the arch opening, thereby reducing stress on the limb under the pillow. Several embodiments of the pillow member shape are contemplated.

SUMMARY OF THE INVENTION

The following summary is intended solely for the benefit of the reader and is not intended to be limiting in any way. The present invention provides a new flexible pillow device that can be utilized for providing convenience for the user when sleeping in various positions and while sleeping with a partner.

It is therefore an object of the present invention to provide a new and improved flexible pillow device that has all of the advantages of the prior art and none of the disadvantages.

It is another object of the present invention to provide a flexible pillow device that comprises a plurality of pillow members, each pillow member having a pair of sides, a length, a height, an upper surface, and a lower surface. Each pillow member is connected to at least one adjacent pillow member along one of its sides at an outermost lateral portion along the sides thereof.

Another object of the present invention is to provide a flexible pillow device that comprises pillow members that are connected to adjacent pillow members via a pivotal connection disposed at each outermost lateral portion.

Another object of the present invention is to provide a flexible pillow device with pillow members having rotatable connection relative to an adjacent pillow member using a pivotal connection such that the plurality of pillow members can operably form an aligned, flat shape, or a curving, arch shape with an open interior.

Another object of the present invention is to provide a flexible pillow device that comprises an outermost lateral portion along the sides of each pillow member that extends along the entire extent of each side, the outermost later portion comprising a surface or a point that is laterally outboard such that the pivotal connection between pillow members allows each pillow member to rotate relative to the adjacent pillow member.

Another object of the present invention is to provide a flexible pillow device that comprises pillow members having an outer surface an interior cushioning material.

Another object of the present invention is to provide a flexible pillow device comprising pillow members having a pair of sides in which is substantially perpendicular to the upper surface of the pillow member, and a second side surface that is disposed at an inward angle relative to the first side surface such that the second side surface of each of the pillow members angles away from an adjacent pillow.

Another object of the present invention is to provide a flexible pillow device comprising pillow members having a lower surface and the upper surface that are parallel to one another, the lower surface connecting to the second side surfaces of the sides to form a smaller lower surface than the upper surface.

Another object of the present invention is to provide a flexible pillow device in which each of the pillow members comprises a rectangular cross section with a pair of upper corners and a pair of lower corners, the lower corners being inboard of the upper corners such that the sides of each pillow member are chamfered inward.

Another object of the present invention is to provide a flexible pillow device in which the pivotal connection between the pillow members further comprises a sewn line of connection.

Another object of the present invention is to provide a flexible pillow device in which the pivotal connection between the pillow members further comprises an elastic surface extending between adjacent pillow members.

Another object of the present invention is to provide a flexible pillow device in which the pivotal connection between the pillow members further comprises a fabric surface disposed between adjacent pillow members.

Yet another object of the present invention is to provide a flexible pillow device in which each of the pillow members comprises a rectangular cross section with a pair of upper corners and a pair of lower corners, the lower corners being inboard of the upper corners such that the sides of each pillow member are chamfered inward at an angle.

Another object of the present invention is to provide a flexible pillow device in which each of the pillow members comprises a rounded cross section, and wherein the upper surface comprises a rounded profile and the lower surface comprises a rounded profile Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
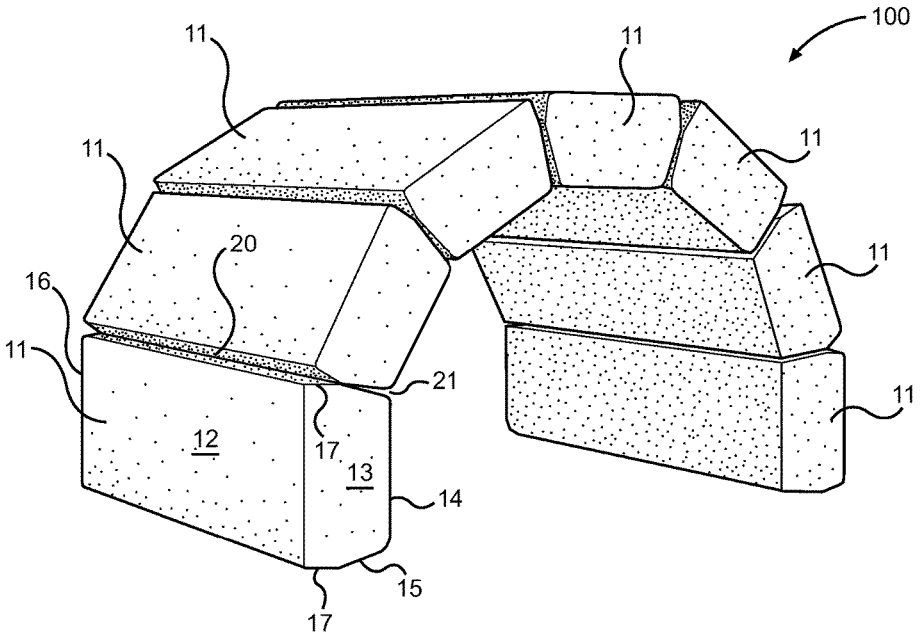
FIG. 1 shows a perspective view of the pillow device of the present invention in an arch configuration.

Reference is made herein to the attached drawings. Like reference numerals are used throughout the drawings to depict like or similar elements of the pillow device of the present invention. For the purposes of presenting a brief and clear description of the present invention, the preferred embodiment will be discussed as used for providing support to a user while offering the ability to be situated in a flat or arched configuration. The figures are intended for representative purposes only and should not be considered to be limiting in any respect.

Figure 2:
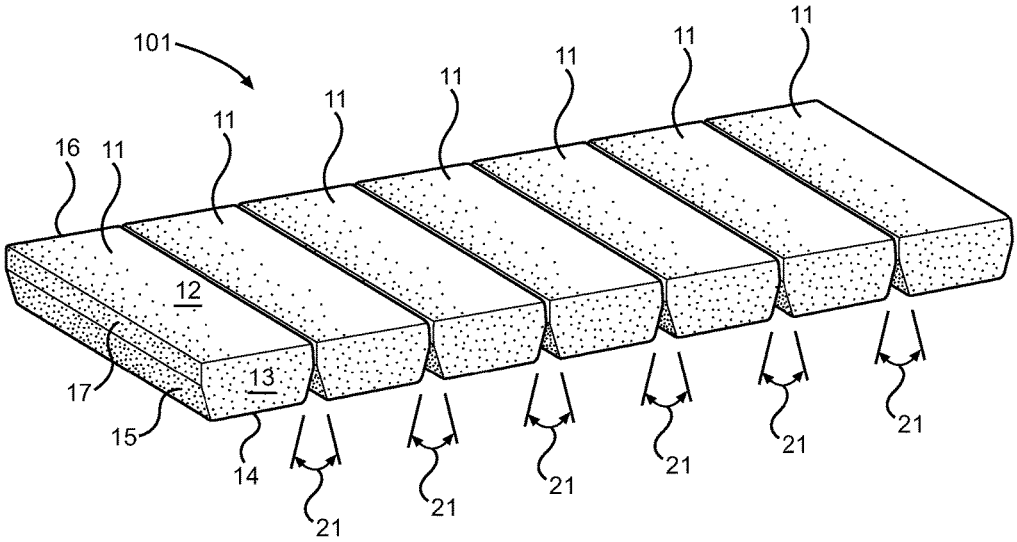
FIG. 2 shows a perspective view of the pillow device of the present invention in a flat configuration.

Referring now to FIGS. 1 and 2, there are shown views of the pillow device of the present invention in two states. The pillow device of the present invention comprises a plurality of pillow members 11 that are connected along their sides to form a row of pillow members. The connection between pillow members and the shape of each pillow member allows each adjacent pillow member 11 to rotate relative to their connection point, thereby allowing the pillow device to form a flat, aligned shape 101, or a curved, arch shape 100 with an open interior. FIG. 1 represents an embodiment of the pillow members and the pillow device in the shape of an arch 100. FIG. 2 represents an embodiment of the pillow members and the pillow device in the shape of a flat, aligned shape 101.

In an arch shape 100, the pillow device provides pillow members 11 upon which the user can rest a portion of his or her body. The arch shape 100 forms an open interior, through which a user can place one or more of his or her limbs therethrough. This shape accommodates sleeping on one's side, sleeping on one's stomach, and certain positions in which a user is sleeping with a partner. Along with the arch and flat shapes, the pillow can also form a contoured shape over a multi-faceted or multi-curved shape (i.e. an S-shape or the like).

The pillow members 11 of the present invention are cushioned members an outer surface and a structure that provides cushioning when pressed upon. Embodiments include interior cushioning material with a removable exterior fabric surface, single-piece embodiments (i.e. foam blocks or the like), or other embodiments that form a pillow member that can connect to adjacent pillow members. In one embodiment, the pillow members 11 are elongated members having lateral sides, an upper surface 12, a lower surface 14, a first end 13, a second end 16, and a pivotal connection between one or more adjacent pillow members along the lateral sides of the pillow member.

The pillow members 11 rotate relative to one another to operatively form a flat shape 101 or an arch shape 100. In one embodiment, the lateral sides of the pillow members comprise a first side surface 17 that is substantially perpendicular to the upper surface 12, and a second side surface 15 that is disposed at an inward angle relative to the first side surface 17 such that the second side surface 15 of each of the pillow members 11 angles away from an adjacent pillow. The edge between the first side surface 17 and the second side surface 15 forms an outermost lateral portion extending along the sides of the pillow member.

Each adjacent pillow member is connected to the pillow member via a pivotal connection disposed the outermost lateral portion. The angled second side surface 15 and the pivotal connection allow two adjacent pillow members to rotate about their connection point. In the arch shape, the second side surfaces 15 of adjacent pillow members bear against one another to form a stable shape. Likewise, the first side surfaces 17 of adjacent pillow members move away from one another to form a gap 20 between adjacent pillow members in the arch shape.

Several embodiments are contemplated with respect to the cross sectional shape of the pillow members 11. In the shape provided in FIGS. 1-3A, the pillow members comprise substantially rectangular shapes with lateral sides being formed of a two faceted surfaces (i.e. the first side surface 17 and the second side surface 15). The second side surface 15 is angled inward toward the pillow member centerline and at an angle. This angle may vary depending on the number of pillow members, but the angle preferably is determined based on forming a 180 degree arch with the number of pillow members connected together. Therefore, in FIG. 2, seven pillow members 11 are connected, forming six connections. To form a 180 degree arch with equal separation between each pillow member when rotated relative to one another, the six connections must individually form thirty degree separations 21. Therefore, the second side surface 15 in this embodiment is angled inward at fifteen degrees. When adjacent pillow members are rotated toward each other, the combined angles form the 180 degree arch required. It is noted that it is not a requirement of the claimed invention to form a 180 degree arch, but is one embodiment. The exact angular separation 21 is not limited to the recited embodiment above.

Figure 3A:
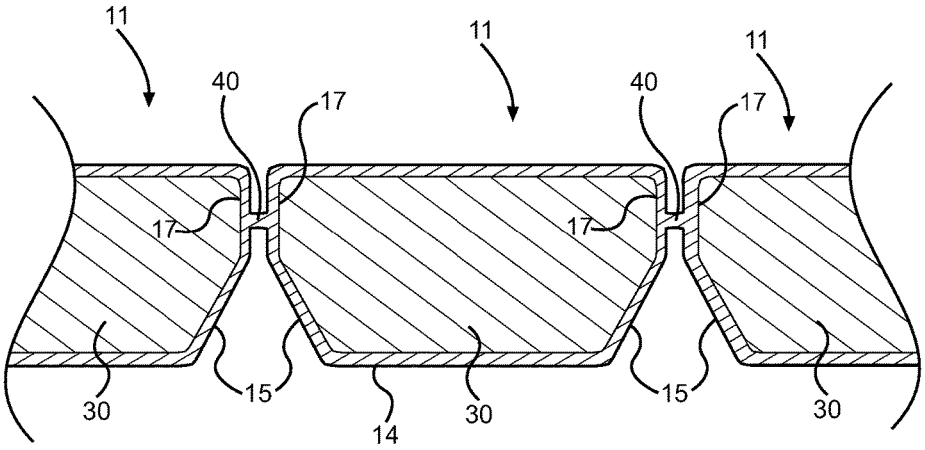
FIG. 3A shows a cross section of an embodiment of the pillow members of the present invention.
Figure 3B:
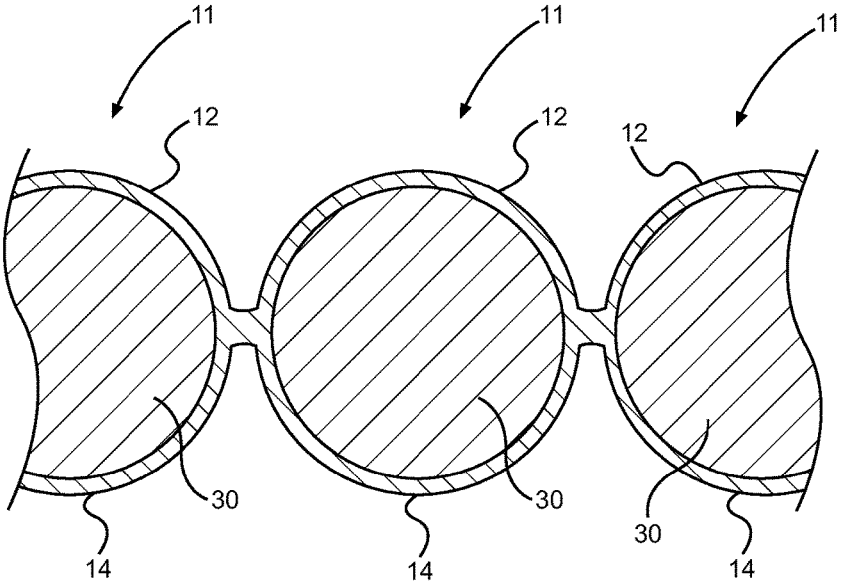
FIG. 3B shows a cross section of an embodiment of the pillow members of the present invention.

Referring to FIGS. 3A and 3B, there are shown two embodiments of the present invention. FIG. 3A provides a cross-section view of an embodiment that comprises a substantially rectangular pillow member 11. In this embodiment, each side of the pillow member comprises a first side surface 17 that is substantially perpendicular to an upper surface, and a second side surface 14 that is disposed at an inward angle relative to the first side surface 17 such that the second side surface 15 of each of the pillow members 11 angles away from an adjacent pillow. This embodiment further comprises a lower surface 14 and the upper surface that are substantially parallel to one another, the lower surface 14 connecting to the second side surfaces 15 of the sides to form a smaller lower surface 14 than an upper surface. This embodiment further comprises the pillow members 11 with a pair of upper corners and a pair of lower corners, the lower corners being inboard of the upper corners such that the sides of each pillow member are chamfered inward. The chamfer is at a defined angle that allows the second side surfaces 15 of the pillow members to bear against one another when the pillow members are pivoted towards one another in the arch shape.

Referring to FIG. 3B, this view illustrates another embodiment of the pillow members 11, whereby the pillow members 11 comprise a rounded upper surface 12 and a rounded lower surface 14. The rounded upper surface 12 and the rounded lower surface 14 form a pillow member 11 that is substantially rounded or circular. The interior of each embodiment comprises a cushioning material 30 that compresses and cushions a user resting on the pillow member.

Connecting each of the pillow members is a pivotal connection 40 disposed along the lateral portion of each adjacent pillow member. Several embodiments are contemplated for the pivotal connection 40. The function of the pivotal connection is to connection adjacent pillow members, while also allowing each pillow member to pivot relative to one another to operatively form the arch shape or flat shape. Embodiments of the pivotal connection 40 include a sewn line of connection between the adjacent pillow members, an elastic surface between adjacent pillow members, and a fabric surface between adjacent pillow members. Any structure that is capable of connecting adjacent pillow members while allowing the pillow members the flexibility or freedom to rotate about the connection is contemplated. The pivotal connection may extend along the entire sides of the pillow members, or along a portion thereof.

Figure 4:
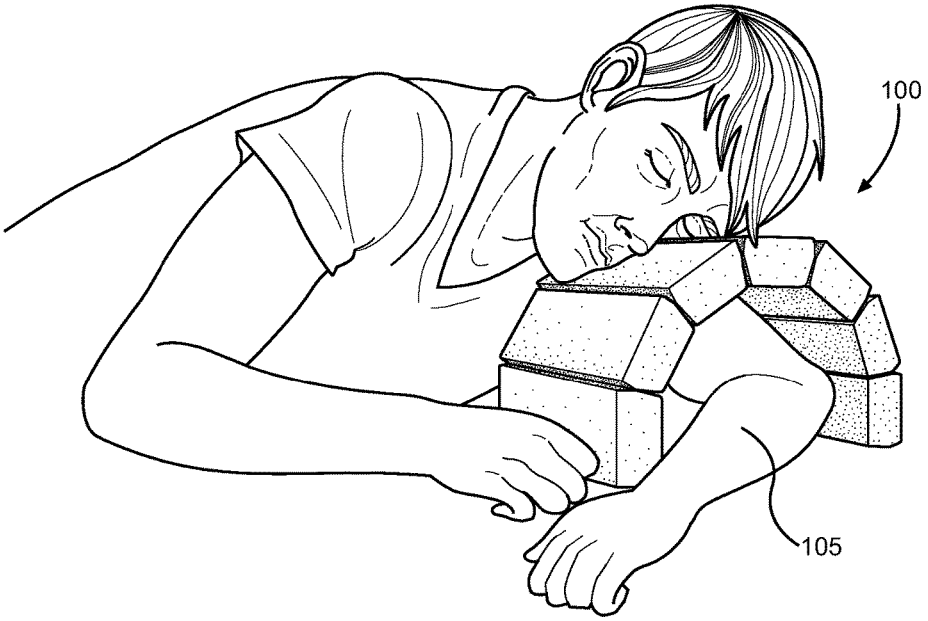
FIG. 4 shows a view of the pillow device of the present invention being used in an arch shape.
Figure 5:
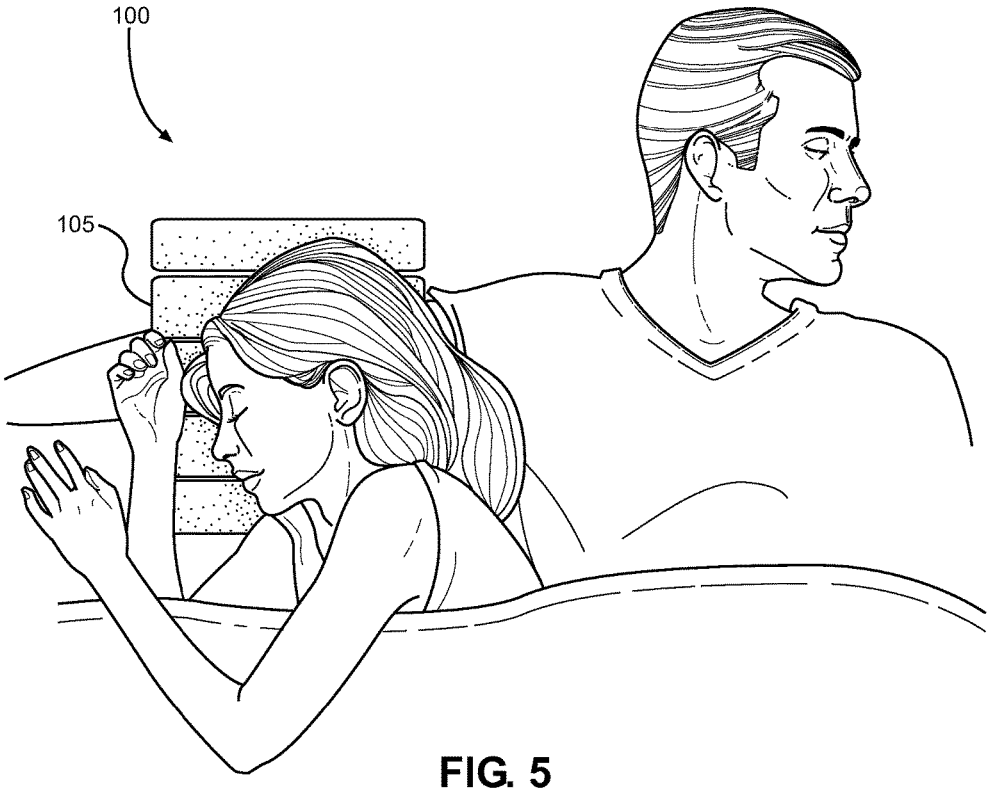
FIG. 5 shows another view of the pillow device of the present invention being used in an arch shape.
Figure 6:
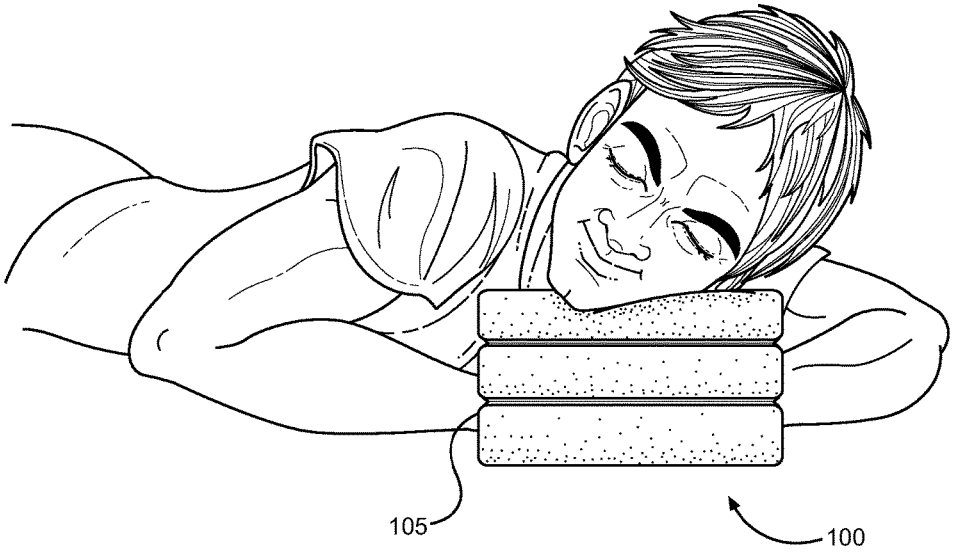
FIG. 6 shows yet another view of the pillow device of the present invention being used in an arch shape.

Referring now to FIGS. 4-6, there are shown various views of the pillow device of the present invention in a working state. The views show the pillow device in an arch shape 100, whereby the open interior 105 of the arch shape accommodates a limb or body part of the user while resting alone or with a partner. The present invention enables a user's head to remain elevated without applying pressure to limbs disposed within the open interior 105 of the device while in an arch shape. The device is a flexible structure that enables a user to manually manipulate the device in order to form it into a desired shape, whereby the pillow device can retain a freestanding arch shape if desired. The invention may be constructed from cotton, polyester, nylon, wood and/or other suitable materials. The device may be available in different sizes, colors, and designs to suit user preferences. The exact size, measurement, construction, and design specifications may vary upon manufacturing.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flexible pillow device, comprising: a plurality of pillow members; each pillow member having a pair of sides, a length, a height, an upper surface, and a lower surface; whereby each pillow member is connected to at least one adjacent pillow member along one of its sides; whereby each pillow member further comprises an outermost lateral portion along the sides thereof; whereby each pillow member is connected to an adjacent pillow member via a pivotal connection disposed at each outermost lateral portion; whereby each pillow member is rotatable relative to an adjacent pillow member about the pivotal connection such that the plurality of pillow members can operably form a flat shape or an arch shape with an open interior; wherein the pair of sides is configured to bear against an adjacent pillow member of the plurality of pillow members in the arch shape in a self-supporting position, wherein the arch shape is configured to support a head resting thereon and retain die arch shape; wherein: each of the pillow members comprises a rectangular cross section with a pair of upper corners and a pair of lower corners; the lower corners being inboard of the upper corners such that the sides of each pillow member are chamfered inward.

2. The flexible pillow device of claim 1, wherein:

the outermost lateral portion along the sides of each pillow member extends along the entire extent of each side.

3. The flexible pillow device of claim 1, wherein each pillow member further comprises an outer surface and an interior cushioning material.

4. The flexible pillow device of claim 1, wherein:

each side of the pillow members further comprises a first side surface that is substantially perpendicular to the upper surface, and a second side surface that is disposed at an inward angle relative to the first side surface such that the second side surface of each of the pillow members angles away from an adjacent pillow.

5. The flexible pillow device of claim 1, wherein:

each side of the pillow members further comprises a first side surface that is substantially perpendicular to the upper surface, and a second side surface that is disposed at an inward angle relative to the first side surface such that the second side surface of each of the pillow members angles away from an adjacent pillow; and wherein the lower surface and the upper surface are parallel to one another, the lower surface connects to the second side surfaces of the sides and forms a smaller surface than the upper surface.

6. The flexible pillow device of claim 1, wherein the pivotal connection further comprises a sewn line of connection.

7. The flexible pillow device of claim 1, wherein the pivotal connection further comprises an elastic surface between adjacent pillow members.

8. The flexible pillow device of claim 1, wherein the pivotal connection further comprises a fabric surface between adjacent pillow members.

9. The flexible pillow device of claim 1, wherein:

each of the pillow members comprises a rectangular cross section with a pair of upper corners and a pair of lower corners;

the lower corners being inboard of the upper corners such that the sides of each pillow member are chamfered inward at a fifteen degree angle.

* * * * *